US009357325B2

(12) United States Patent
Lee et al.

(10) Patent No.: US 9,357,325 B2
(45) Date of Patent: May 31, 2016

(54) APPARATUS AND METHOD FOR GENERATING MULTIMEDIA DATA, AND APPARATUS AND METHOD FOR PLAYING MULTIMEDIA DATA

(71) Applicant: Electronics and Telecommunications Research Institute, Daejeon (KR)

(72) Inventors: Yong Ju Lee, Daejeon (KR); Jeong Il Seo, Daejeon (KR); Keunwoo Choi, Seoul (KR); Tae Jin Park, Seoul (KR); Kyeong Ok Kang, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 127 days.

(21) Appl. No.: 14/049,333

(22) Filed: Oct. 9, 2013

(65) Prior Publication Data

US 2014/0140515 A1 May 22, 2014

(30) Foreign Application Priority Data

Nov. 20, 2012 (KR) ..... 10-2012-0131373

(51) Int. Cl.
*H04S 5/00* (2006.01)

(52) U.S. Cl.
CPC ..... *H04S 5/005* (2013.01); *H04S 2400/03* (2013.01); *H04S 2400/11* (2013.01); *H04S 2400/15* (2013.01)

(58) Field of Classification Search
None
See application file for complete search history.

(56) References Cited

U.S. PATENT DOCUMENTS

| | | | | |
|---|---|---|---|---|
| 2007/0008193 | A1* | 1/2007 | Liebchen | 341/50 |
| 2008/0013430 | A1* | 1/2008 | Rivas Quesada et al. | 369/59.1 |
| 2009/0080632 | A1* | 3/2009 | Zhang et al. | 379/202.01 |
| 2010/0135510 | A1* | 6/2010 | Yoo | G10L 19/008 381/300 |
| 2012/0057715 | A1 | 3/2012 | Johnston et al. | |

OTHER PUBLICATIONS

US 7,908,148, 03/2011, Pang et al. (withdrawn)

* cited by examiner

*Primary Examiner* — Paul Huber
(74) *Attorney, Agent, or Firm* — William Park & Associates Ltd.

(57) ABSTRACT

An apparatus and method for generating multimedia data and an apparatus and method for playing multimedia data are disclosed. The apparatus for generating the multimedia data may include a spatial information identification unit to identify spatial information for a plurality of channels of a multi-channel audio signal, and a multimedia data generation unit to generate multimedia data including the spatial information, and the apparatus for playing the multimedia data may include a spatial information analysis unit to analyze spatial information for a plurality of channels of a multi-channel audio signal included in multimedia data, and a multimedia data playback unit to play multimedia data, based on the spatial information.

21 Claims, 6 Drawing Sheets

APPARATUS AND METHOD FOR GENERATING MULTIMEDIA DATA, AND APPARATUS AND METHOD FOR PLAYING MULTIMEDIA DATA

CROSS-REFERENCE TO RELATED APPLICATION

This application claims the priority benefit of Korean Patent Application No. 10-2012-0131373, filed on Nov. 20, 2012, in the Korean Intellectual Property Office, the disclosure of which is incorporated herein by reference.

BACKGROUND

1. Field of the Invention

The present invention relates to an apparatus and method for generating multimedia data including spatial information for a plurality of channels of a multi-channel audio signal, and an apparatus and method for playing multimedia data.

2. Description of the Related Art

Information about a number of signals configuring audio content, a channel to be disposed in a space, and a portion in the space in which the channel is to be disposed may be required to embody an audio signal into a multi-channel. A 5.1 channel audio signal is currently being produced and played under a condition in which a total of six signals are produced and played at positions of 0, +30, +110, +250, +330, and null degrees.

With developments in ultra high definition television (UHDTV) technology, and use of a greater number of speakers than the 5.1 channel provided by a high definition television (HDTV), research into an audio playback scheme with a greater sense of realism is garnering attention. As a demand for a high quality of multimedia content increases, use of multimedia content including multi-channel audio content, such as a 7.1 channel, a 10.2 channel, a 13.2 channel, and the like, rather than the 5.1 channel, is gradually increasing.

Also, discussions as to a disposition of a speaker for playing a multi-channel audio are taking a great leap forward. Although an equal number of speakers is used, the disposition of the speaker in a space may differ. In particular, an audio conveyed to a user may vary based on a configuration in which a speaker is disposed when the multi-channel audio content is played. Accordingly, the disposition of the speaker for playing the audio content may be of significance when the multi-channel audio content is played.

Playing the multi-channel audio content may face a degree of difficulty because a multi-channel audio format currently being used may not include information associated with the multi-channel audio content and the disposition of the speaker. Accordingly, there is a desire for more efficient representation and playing of the multi-channel audio content.

SUMMARY

According to an aspect of the present invention, there is provided an apparatus for generating multimedia data, the apparatus including a spatial information identification unit to identify spatial information for a plurality of channels of a multi-channel audio signal, and a multimedia data generation unit to generate multimedia data including the spatial information.

According to an aspect of the present invention, there is provided an apparatus for playing multimedia data, the apparatus including a spatial information analysis unit to analyze spatial information for a plurality of channels of a multi-channel audio signal included in multimedia data, and a multimedia data playback unit to play multimedia data, based on the spatial information.

According to an aspect of the present invention, there is provided a method for generating multimedia data, the method including identifying spatial information for a plurality of channels of a multi-channel audio signal, and generating multimedia data including the spatial information.

According to an aspect of the present invention, there is provided a method for playing multimedia data, the method including analyzing spatial information for a plurality of channels of a multi-channel audio signal included in multimedia data, and playing multimedia data, based on the spatial information.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION

Figure 1:
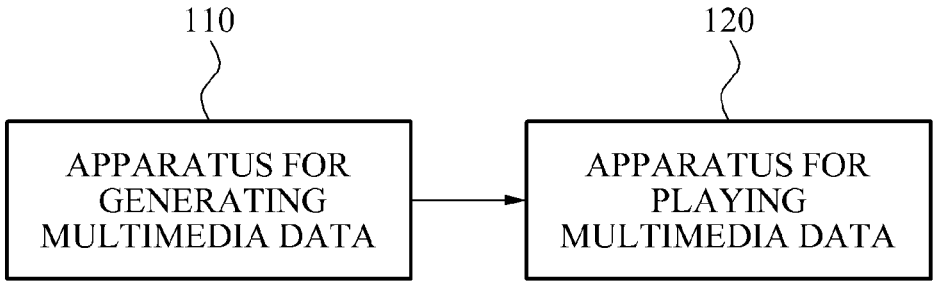
FIG. 1 is a diagram illustrating an operation of generating and playing multimedia data according to an embodiment of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

FIG. 1 is a diagram illustrating an operation of generating and playing multimedia data according to an embodiment of the present invention.

An apparatus 110 for generating multimedia data may generate multimedia data including a multi-channel audio signal. Alternatively, the apparatus 110 for generating the multimedia data may generate multimedia data including playback information of a multi-channel audio signal.

For example, the apparatus 110 for generating the multimedia data may generate multimedia data including spatial information indicating the multi-channel audio signal to be played in a space. The spatial information may include speaker disposition information appropriate for playing the multi-channel audio signal. The spatial information may be included in the multimedia data during a process of generating or editing the multimedia data or a process of encoding.

The apparatus 110 for generating the multimedia data may store the spatial information in header information of the multimedia data.

For example, in a case of a multi-channel audio signal of a 10.2 channel, the apparatus 110 for generating the multimedia data may generate multimedia data including location information of twelve speakers in the header information of the multimedia data.

The apparatus 110 for generating the multimedia data may generate multimedia data in a form of a bitstream. The bitstream may include the multimedia data and the header information associated with the multimedia data. The header information may include location information indicating a location at which an audio signal for a plurality of channels of a multi-channel audio signal is to be played, and speaker matching information, for example, information about a speaker matched to the audio signal for the plurality of channels of the multi-channel audio signal.

An apparatus 120 for playing multimedia data may play the multimedia data generated by the apparatus 110 for generating the multimedia data. The apparatus 120 for playing the multimedia data may analyze the spatial information included in the multimedia data, and play a multi-channel audio signal, based on the spatial information analyzed.

For example, the apparatus 120 for playing the multimedia data may play multimedia data, based on the speaker disposition information included in the spatial information. The apparatus 120 for playing the multimedia data may select a speaker to output an audio signal of a channel, and the channel from which the audio signal is outputted. The apparatus 120 to for playing the multimedia data may output an audio signal for a plurality of channels corresponding to a plurality of speakers, using a corresponding speaker.

The apparatus 120 for playing the multimedia data may play the multi-channel audio signal efficiently, using the spatial information for the plurality of channels of the multi-channel audio signal included in the multimedia data.

Figure 2:
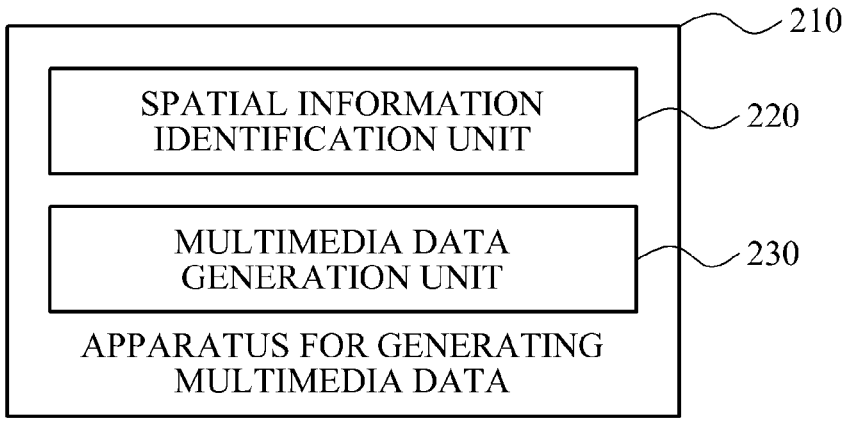
FIG. 2 is a diagram illustrating a detailed configuration of an apparatus for generating multimedia data according to an embodiment of the present invention.

FIG. 2 is a diagram illustrating a detailed configuration of an apparatus 210 for generating multimedia data according to an embodiment of the present invention.

Referring to FIG. 2, the apparatus 210 for generating the multimedia data may include a spatial information identification unit 220 and a multimedia data generation unit 230.

The spatial information identification unit 220 may identify spatial information for a plurality of channels of a multi-channel audio signal. For example, the spatial information identification unit 220 may identify at least one of location information of a speaker for a plurality of channels and matching information of a channel and a speaker from a multi-channel audio signal.

The spatial information may include location information associated with a playback of an audio signal for a plurality of channels of a multi-channel audio signal. For example, the location information may indicate a location of speakers at which the multi-channel audio signal is to be played. More particularly, the location information may indicate a location of a speaker through which an audio signal for a plurality of channels of a multi-channel audio signal is to be played.

The location information may be configured in a form of a three-dimensional (3D) coordinate. More particularly, the location information may have a form of a 3D coordinate, based on an x axis, a y axis, and a z axis in a 3D space. For example, a reference axis may be established based on a point at which an apparatus for playing the multimedia data is disposed, a location of a user, and a horizontal surface, and the two remaining axes may be established based on the reference axis. The location information may be stored in a form of (3 meters (m), 4 m, 5 m), and the like, based on the three axes established. A multimedia data generation unit 230 may store the location information corresponding to a plurality of audio channels in header information of the multimedia data.

The location information may be configured by at least one of horizontal azimuth information, vertical azimuth information, and distance information. For example, the location information may be stored in a form of (330 degrees, 0 degrees, 4 m), and the like. Transitively, (330 degrees, 0 degrees, 4 m) may indicate that an audio signal of a channel corresponding to location information is to be played at a location at which a reference point, for example, a location of an apparatus for generating multimedia data, is 4 m away, the horizontal azimuth is 330 degrees, and the vertical azimuth is 0 degrees.

When speakers are disposed at regular intervals centered around the reference point, the location information may have a form of horizontal azimuth information and vertical azimuth information. For example, the location information may be stored in a form of (330 degrees, 0 degrees), and the like. Transitively, (330 degrees, 0 degrees) may indicate that the audio channel corresponding to the location information is to be played at a location 330 degrees to the horizontal azimuth and 0 degrees to the vertical azimuth. Alternatively, (330 degrees, 0 degrees) may indicate that the speaker corresponding to an audio channel is to be disposed at a location 330 degrees to the horizontal azimuth and 0 degrees to the vertical azimuth. The multimedia data generation unit 230 may set a foreground to be a reference point at 0 degrees, based on a horizontal surface when a user faces forward, and set the horizontal azimuth and the vertical azimuth through turning a direction of a clock to be a positive (+) direction.

Also, the spatial information may include the speaker matching information indicating a speaker to which an audio signal for a plurality of channels of a multi-channel audio signal is matched. For example, the speaker matching information may include information that sets audio signals for a plurality of channels to match each of a plurality of speakers.

The multimedia data generation unit 230 may generate multimedia data including spatial information for a plurality of channels of a multi-channel audio signal. The multimedia data generation unit 230 may store the spatial information for the plurality of channels of the multi-channel audio signal in the header information.

The multimedia data generated in the multimedia data generation unit 230 may be provided to the apparatus for playing the multimedia data through being encoded or multiplexed.

Figure 3:
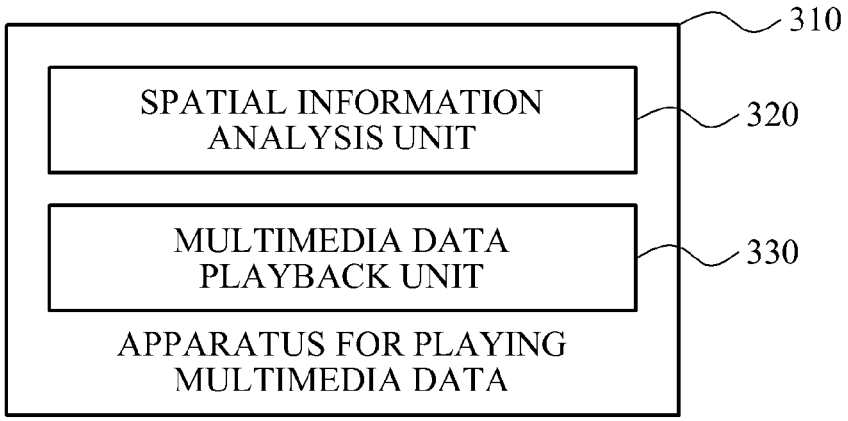
FIG. 3 is a diagram illustrating a detailed configuration of an apparatus for playing multimedia data according to an embodiment of the present invention.

FIG. 3 is a diagram illustrating a detailed configuration of an apparatus 310 for playing multimedia data according to an embodiment of the present invention.

Referring to FIG. 3, the apparatus 310 for playing the multimedia data may include a spatial information analysis unit 320 and a multimedia data playback unit 330.

The spatial information analysis unit 320 may analyze spatial information for a plurality of channels of a multi-channel audio signal included in multimedia data. For example, the spatial information analysis unit 320 may obtain playback information of a multi-channel audio signal through analyzing the spatial information present in header information of the multimedia data. The spatial information analysis unit 320 may extract, from the spatial information, speaker disposition information indicating speaker disposition conditions under which an audio signal for a plurality of channels of a multi-channel audio signal is to be played.

The spatial information may include location information associated with a playback of the audio signal for the plurality of channels of the multi-channel audio signal. The location information may be configured in a form of a 3D coordinate, and the location information corresponding to a plurality of audio channels may exist. For example, the location information may be stored in a form of (1 m, 0 m, 4 m), and the like, based on an x axis, a y axis, and a z axis.

Alternatively, the location information may be configured by at least one of horizontal azimuth information, vertical azimuth information, and distance information. For example, the location information may be stored in a form of (180 degrees, 20 degrees, 3 m), and the like. When speakers are disposed at regular intervals centered around a reference point, the location information may have a form of the horizontal azimuth information and the vertical azimuth information. For example, the location information may be stored in a form of (270 degrees, 30 degrees), and the like. Transitively, (270 degrees, 30 degrees) may indicate that an audio channel corresponding to location information is to be played at a location 270 degrees to a horizontal azimuth, and 30 degrees to a vertical azimuth. Alternatively, (270 degrees, 30 degrees) may indicate that a speaker corresponding to an audio channel is to be disposed at a location 270 degrees to the horizontal azimuth and 30 degrees to the vertical azimuth.

The spatial information may include speaker matching information that sets an audio signal for a plurality of channels of a multi-channel audio signal to correspond to a plurality of speakers. The spatial information analysis unit 320 may select a speaker through which the audio signal for the plurality of channels of the multi-channel audio signal is to be played, using the speaker matching information included in the spatial information.

The multimedia data playback unit 330 may play multimedia data, based on the spatial information analyzed in the spatial information analysis unit 320. The multimedia data playback unit 330 may demultiplex or decode the multimedia data.

The multimedia data playback unit 330 may change the speaker matching information, based on audio playback settings of the multimedia data, and play the multimedia data, based on the changed speaker matching information. For example, the multimedia data playback unit 330 may change the speaker matching information, such that a location of actual speakers corresponds to a location of a speaker included in the speaker matching information when actual speaker disposition settings fail to correspond to the speaker disposition information included in the speaker matching information. For example, the multimedia playback unit 330 may set an actual speaker disposed closest to a position of a plurality of speakers included in the speaker matching information to correspond to an audio signal for a plurality of channels.

The multimedia data playback unit 330 may play a multi-channel audio signal through converting the multi-channel audio signal, based on the audio playback settings of the multimedia data. For example, the multimedia data playback unit 330 may down mix an audio signal of a multi-channel included in multimedia data when a number of playable audio channels is less than a number of audio channels included in the multimedia data. For example, when the apparatus 310 for playing the multimedia data that plays audio content of a 5.1 channel receives multimedia data including audio content of a 10.1 channel, the multimedia data playback unit 330 may down mix the audio content of the 10.1 channel to convert to the audio content of the 5.1 channel. The multimedia data playback unit 330 may down mix a multi-channel audio signal through a scheme for combining an audio signal for a plurality of channels in the multi-channel audio signal.

Figure 4:
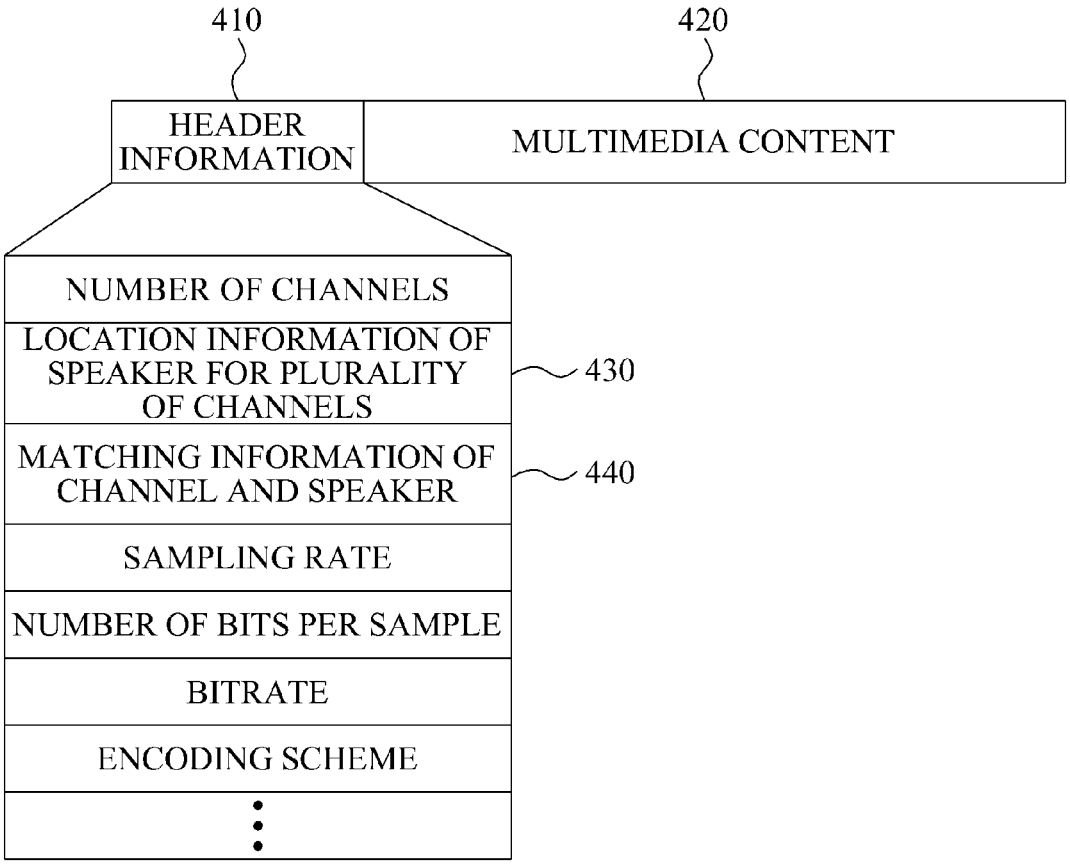
FIG. 4 is a diagram illustrating an example of a structure of multimedia data according to an embodiment of the present invention.

FIG. 4 is a diagram illustrating an example of a structure of multimedia data according to an embodiment of the present invention.

The multimedia data may include multimedia content 420 and header information 410 associated with the multimedia content 420. Also, the multimedia content 420 may include audio content of a multi-channel, and the header information 410 may include information associated with the audio content of the multi-channel.

The header information 410 associated with the audio content may include information associated with a number of audio channels, a name of an audio channel, an audio sampling rate, a number of bits per sample, a bitrate, an encoding scheme, and the like. For example, when the audio content included in the multimedia content 420 is a 10.2 channel, a number of audio channels "12", a name of the audio channels, "L, R, C, LH, RH, LS, RS, LB, RB, TC, LFE1, LFE2", a bitrate "192 kilobits per second (kbps)", and the like, may be included in the header information 410.

An apparatus for generating multimedia data may further include spatial information for a plurality of channels of a multi-channel audio signal. For example, the header information 410 generated by the apparatus for generating the multimedia data may include information indicating a location of a speaker for a plurality of audio channels, for example, location information 430 of a speaker for a plurality of channels, and information indicating a speaker matching an audio channel, for example, matching information 440 of a channel and a speaker.

The location information 430 of the speaker for the plurality of channels may include location information of an audio signal for a plurality of channels of a multi-channel audio signal. The location information 430 of the speaker for the plurality of channels may indicate a location in a space in which an audio signal for a plurality of channels of a multi-channel audio signal is to be played. For example, the location information 430 of the speaker for the plurality of channels may indicate a location of a speaker through which an audio signal for a plurality of channels of a multi-channel audio signal is to be played. The location information 430 of the speaker for the plurality of channels may be configured in a form of at least one of a 3D coordinate, a horizontal azimuth information, a vertical azimuth information, and distance information. For example, the location information 430 of the speaker for the plurality of channels may be configured by horizontal azimuth information, vertical azimuth information, and distance information. When speakers are disposed at regular intervals, centered around a reference point, the location information 430 of the speaker for the plurality of channels may have a form of the horizontal azimuth information and the vertical azimuth information.

The matching information 440 of the channel and the speaker may include speaker matching information matched to an audio signal for a plurality of channels of a multi-channel audio signal. The matching information 440 of the channel and the speaker may indicate that a speaker to which the audio signal for the plurality of channels of the multi-channel audio signal is matched. For example, the matching information 440 of the channel and the speaker may include information that sets audio signals for a plurality of channels to match each of a plurality of speakers.

The apparatus for playing the multimedia data may play multimedia data in an optimal speaker disposition condition, using the header information 410 included in the multimedia data. The apparatus for playing the multimedia data may determine a location in a space in which an audio signal for a plurality of channels is to be played using the matching information 440 of the channel and the speaker, and determine a location of a speaker at which the audio signal for the plurality of channels is to be played.

Figure 5:
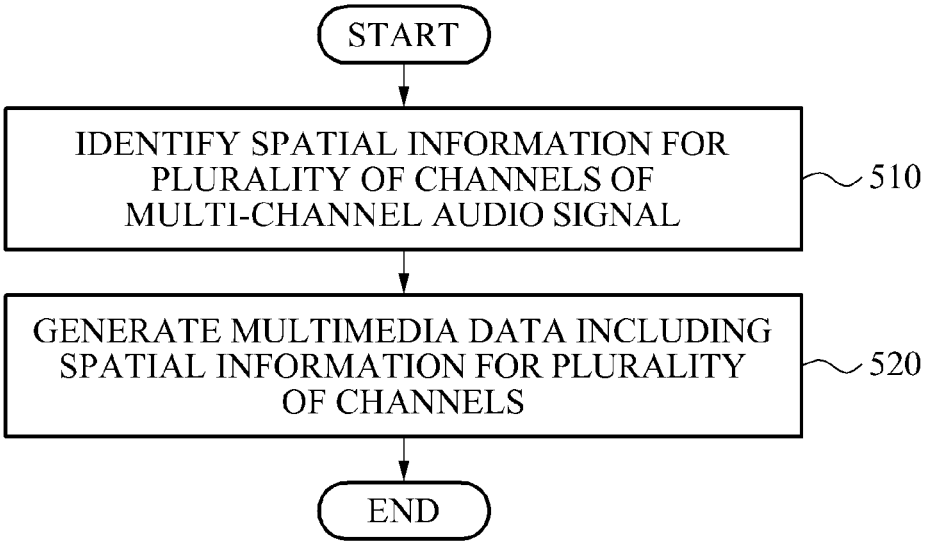
FIG. 5 is a flowchart illustrating an operation of a method for generating multimedia data according to an embodiment of the present invention.

FIG. 5 is a flowchart illustrating an operation of a method for generating multimedia data according to an embodiment of the present invention.

In operation 510, an apparatus for generating multimedia data may identify spatial information for a plurality of channels of a multi-channel audio signal. For example, the apparatus for generating the multimedia data may identify at least one of location information of a speaker for a plurality of channels, and matching information for a channel and a speaker from a multi-channel audio signal.

The spatial information may include location information associated with a playback of an audio signal for a plurality of channels of a multi-channel audio signal. For example, the location information may indicate a location of speakers at which a multi-channel audio signal is to be played. The location information may be configured in a form of a 3D coordinate. More particularly, the location information may have a form of a 3D coordinate, based on an x axis, a y axis, and a z axis in a 3D space. Also, the location information may be configured by at least one of horizontal azimuth information, vertical azimuth information, and distance information.

Also, the spatial information may include speaker matching information that sets an audio signal for a plurality of channels of a multi-channel audio signal to correspond to a plurality of speakers. For example, the speaker matching information may include information that sets audio signals for a plurality of channels to match each of a plurality of speakers.

In operation 520, the apparatus for generating the multimedia data may generate multimedia data including spatial information for a plurality of channels of a multi-channel audio signal. The apparatus for generating the multimedia data may store the spatial information for a plurality of channels of a multi-channel audio signal in header information of the multimedia data.

The apparatus for generating the multimedia data may generate the multimedia data in a form of a bitstream. The bitstream may include the multimedia data and the header information associated with the multimedia data. The header information may include location information indicating a location at which an audio signal for a plurality of channels of a multi-channel audio signal is to be played, and speaker matching information that sets the audio signal for the plurality of channels of the multi-channel audio signal to correspond to a plurality of speakers.

Figure 6:
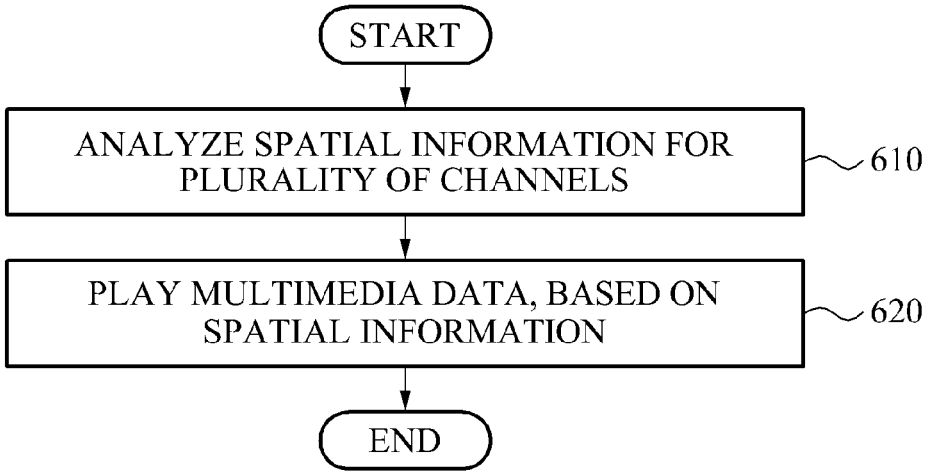
FIG. 6 is a flowchart illustrating an operation of a method for playing multimedia data according to an embodiment of the present invention.

FIG. 6 is a flowchart illustrating an operation of a method for playing multimedia data according to an embodiment of the present invention.

In operation 610, an apparatus for playing multimedia data may analyze spatial information for a plurality of channels of a multi-channel audio signal included in multimedia data. For example, the apparatus for playing the multimedia data may obtain playback information of the multimedia audio signal through analyzing the spatial information present in header information of the multimedia data. The apparatus for playing the multimedia data may extract, from the spatial information, speaker disposition information indicating that a speaker disposition condition in which an audio signal for a plurality of channels of a multi-channel audio signal is to be played.

The spatial information may include location information indicating a location in a space in which the audio signal for the plurality of channels of the multi-channel audio signal is to be played. Also, the spatial information may include speaker matching information indicating a speaker to which the audio signal for the plurality of channels of the multi-channel audio signal is matched. The apparatus for playing the multimedia data may select a speaker through which the audio signal for the plurality of channels of the multi-channel audio signal is to be played, using the speaker matching information included in the spatial information.

In operation 620, the apparatus for playing the multimedia data may play multimedia data, based on the spatial information analyzed in operation 610. The apparatus for playing the multimedia data may demultiplex or decode the multimedia data.

The apparatus for playing the multimedia data may change the speaker matching information, based on audio playback settings, and based on the changed speaker matching information, the multimedia data may be played. For example, the apparatus for playing the multimedia data may compare an actual speaker disposition condition with the speaker disposition information included in the speaker matching information. The apparatus for playing the multimedia data may change the speaker matching information, such that a location of actual speakers corresponds to a location of a speaker included in the speaker matching information when the speaker disposition condition fails to match the speaker disposition information included in the speaker matching information. For example, the apparatus for playing the multimedia data may change the speaker matching information, such that an actual speaker disposed closest to a plurality of speakers included in the speaker matching information may become a speaker corresponding to the speaker matching information.

The apparatus for playing the multimedia data may play the multi-channel audio signal through converting the multi-channel audio signal, based on an audio playback condition of the multimedia data. For example, the apparatus for playing the multimedia data may down mix a multi-channel audio signal included in the multimedia data when a number of playable audio channels is less than a number of audio channels included in the multimedia data. The apparatus for playing the multimedia data may down mix a multi-channel audio signal through a scheme for combining an audio signal for a plurality of channels in the multi-channel audio signal.

The above-described exemplary embodiments of the present invention may be recorded in computer-readable media including program instructions to implement various operations embodied by a computer. The media may also include, alone or in combination with the program instructions, data files, data structures, and the like. Examples of computer-readable media include magnetic media such as hard disks, floppy disks, and magnetic tape; optical media such as CD ROM discs and DVDs; magneto-optical media such as floptical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described exemplary embodiments of the present invention, or vice versa.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. An apparatus for generating multimedia data, the apparatus comprising:

a spatial information identification unit to identify spatial information for a plurality of channels of a multi-channel audio signal; and a multimedia data generation unit to generate multimedia data including the spatial information, wherein the spatial information is configured in a form of a three-dimensional (3D) coordinate based upon an x axis, a y axis, and a z axis in a 3D space, wherein a reference axis is established based upon:

(1) a point at which an apparatus for playing the multimedia data is disposed, (2) a location of a user, and (3) a horizontal surface, and wherein two remaining axes are established based upon the reference axis, wherein the spatial information comprises speaker matching information to set an audio signal for a plurality of channels of a multi-channel audio signal to correspond to respective speakers among a plurality of speakers one on one, and wherein the speaker matching information is changeable, such that an actual speaker disposed closest to a plurality of speakers included in the speaker matching information may become a speaker corresponding to the speaker matching information.

2. The apparatus of claim 1, wherein the spatial information comprises location information of a speaker for a plurality of channels of a multi-channel audio signal.

3. The apparatus of claim 1, wherein the spatial information comprises speaker matching information to set an audio signal for a plurality of channels of a multi-channel audio signal to correspond to respective speakers among a plurality of speakers.

4. The apparatus of claim 1, wherein the multimedia data generation unit comprises spatial information for a plurality of channels of a multi-channel audio signal in header information of multimedia data.

5. The apparatus of claim 2, wherein the location information is configured by at least one of horizontal azimuth information, vertical azimuth information, and distance information.

6. An apparatus for playing multimedia data, the apparatus comprising:

a spatial information analysis unit to analyze spatial information for a plurality of channels of a multi-channel audio signal included in multimedia data; and a multimedia data playback unit to play multimedia data, based on the spatial information, wherein the spatial information is configured in a form of a three-dimensional (3D) coordinate based upon an x axis, a y axis, and a z axis in a 3D space, wherein a reference axis is established based upon:

(1) a point at which an apparatus for playing the multimedia data is disposed, (2) a location of a user, and (3) a horizontal surface, and wherein two remaining axes are established based upon the reference axis, wherein the spatial information comprises speaker matching information to set an audio signal for a plurality of channels of a multi-channel audio signal to correspond to respective speakers among a plurality of speakers one on one, and wherein the speaker matching information is changeable, such that an actual speaker disposed closest to a plurality of speakers included in the speaker matching information may become a speaker corresponding to the speaker matching information.

7. The apparatus of claim 6, wherein the spatial information comprises location information of a speaker for a plurality of channels of a multi-channel audio signal.

8. The apparatus of claim 6, wherein the spatial information comprises speaker matching information to set an audio signal for a plurality of channels of a multi-channel audio signal to correspond to respective speakers among a plurality of speakers.

9. The apparatus of claim 8, wherein the multimedia data playback unit changes the speaker matching information, based on audio playback settings of the apparatus for playing the multimedia data, and plays multimedia data, based on the changed speaker matching information.

10. The apparatus of claim 6, wherein the multimedia data playback unit plays the multi-channel audio signal through converting the multi-channel audio signal, based on audio playback settings of the apparatus for playing the multimedia data.

11. The apparatus of claim 7, wherein the location information is configured by at least one of horizontal azimuth information, vertical azimuth information, and distance information.

12. A method for generating multimedia, the method comprising: identifying spatial information for a plurality of channels of a multi-channel audio signal; and generating multimedia data including the spatial information, wherein the spatial information is configured in a form of a three-dimensional (3D) coordinate based upon an x axis, a y axis, and a z axis in a 3D space, wherein a reference axis is established based upon:

(1) a point at which an apparatus for playing the multimedia data is disposed, (2) a location of a user, and (3) a horizontal surface, and wherein two remaining axes are established based upon the reference axis, wherein the spatial information comprises speaker matching information to set an audio signal for a plurality of channels of a multi-channel audio signal to correspond to respective speakers among a plurality of speakers one on one, and wherein the speaker matching information is changeable, such that an actual speaker disposed closest to a plurality of speakers included in the speaker matching information may become a speaker corresponding to the speaker matching information.

13. The method of claim 12, wherein the spatial information comprises location information of a speaker for a plurality of channels of a multi-channel audio signal.

14. The method of claim 12, wherein the spatial information comprises speaker matching information to set an audio signal for a plurality of channels of a multi-channel audio signal to correspond to respective speakers among a plurality of speakers.

15. A method for playing multimedia data, the method comprising:

analyzing spatial information for a plurality of channels of a multi-channel audio signal included in multimedia data; and playing multimedia data, based on the spatial information, wherein the spatial information is configured in a form of a three-dimensional (3D) coordinate based upon an x axis, a y axis, and a z axis in a 3D space, wherein a reference axis is established based upon:

(1) a point at which an apparatus for playing the multimedia data is disposed, (2) a location of a user, and (3) a horizontal surface, and wherein two remaining axes are established based upon the reference axis, wherein the spatial information comprises speaker matching information to set an audio signal for a plurality of channels of a multi-channel audio signal to correspond to respective speakers among a plurality of speakers one on one, and wherein the speaker matching information is changeable, such that an actual speaker disposed closest to a plurality of speakers included in the speaker matching information may become a speaker corresponding to the speaker matching information.

16. The method of claim 15, wherein the spatial information comprises location information of a speaker for a plurality of channels of a multi-channel audio signal.

17. The method of claim 15, wherein the spatial information comprises speaker matching information to set an audio signal for a plurality of channels of a multi-channel audio signal to correspond to respective speakers among a plurality of speakers.

18. The method of claim 17, wherein the playing of the multimedia data comprises:

changing the speaker matching information, based on audio playback settings of the apparatus for playing the multimedia data, and playing multimedia data, based on the changed speaker matching information.

19. The method of claim 15, wherein the playing of the multimedia data comprises playing the multi-channel audio signal through converting the multi-channel audio signal, based on audio playback settings of the apparatus for playing the multimedia data.

20. An apparatus for generating multimedia data, the apparatus comprising:

a spatial information identification unit to identify spatial information for a plurality of channels of a multi-channel audio signal; and a multimedia data generation unit to generate multimedia data including the spatial information, wherein the spatial information comprises speaker matching information to set an audio signal for a plurality of channels of a multi-channel audio signal to correspond to respective speakers among a plurality of speakers one on one, wherein the speaker matching information is changeable, such that an actual speaker disposed closest to a plurality of speakers included in the speaker matching information may become a speaker corresponding to the speaker matching information.

21. An apparatus for playing multimedia data, the apparatus comprising:

a spatial information analysis unit to analyze spatial information for a plurality of channels of a multi-channel audio signal included in multimedia data; and a multimedia data playback unit to play multimedia data, based on the spatial information, wherein the spatial information comprises speaker matching information to set an audio signal for a plurality of channels of a multi-channel audio signal to correspond to respective speakers among a plurality of speakers one on one, wherein the speaker matching information is changeable by the multimedia data playback unit, such that an actual speaker disposed closest to a plurality of speakers included in the speaker matching information may become a speaker corresponding to the speaker matching information.

* * * * *